US008065749B2

(12) United States Patent
Estrade

(10) Patent No.: US 8,065,749 B2
(45) Date of Patent: Nov. 29, 2011

(54) HAND PROTECTIVE DEVICE

(75) Inventor: David Estrade, Veyre Monton (FR)

(73) Assignee: Medical X'Trem (FR)

( * ) Notice: Subject to any disclaimer, the term of this patent is extended or adjusted under 35 U.S.C. 154(b) by 903 days.

(21) Appl. No.: 12/045,199

(22) Filed: Mar. 10, 2008

(65) Prior Publication Data

US 2008/0263746 A1 Oct. 30, 2008

(30) Foreign Application Priority Data

Mar. 9, 2007 (FR) ..... 07 01732

(51) Int. Cl.
*A41D 19/00* (2006.01)

(52) U.S. Cl. ..... 2/161.1; 2/16; 2/159; 602/2; 602/22

(58) Field of Classification Search ..... 2/16, 159, 2/161.1–161.8, 169; 602/21, 22, 30, 54, 602/57, 58, 59, 61; 128/849
See application file for complete search history.

(56) References Cited

U.S. PATENT DOCUMENTS 5,781,928 A * 7/1998 Avila ..... 2/16

* cited by examiner

*Primary Examiner* — Khoa Huynh
*Assistant Examiner* — Alissa Tompkins
(74) *Attorney, Agent, or Firm* — Cantor Colburn LLP

(57) ABSTRACT

A protective device including a protective sheet having a general rectangular shape, cut into which are four circular openings positioned in an aligned manner level with its transverse median axis which connects the middle of each of the lengths, the four openings separating the protective sheet into a first part known as the palmar part and a second part known as the dorsal part; the protective sheet being coated on one of its sides with a hypoallergenic adhesive; and a peelable film whose longitudinal and transverse dimensions are equal to those of the protective sheet superposed on the side of the protective sheet coated with the hypoallergenic adhesive.

9 Claims, 3 Drawing Sheets

HAND PROTECTIVE DEVICE

This application claims foreign priority to French Application No. 07/01732, filed Mar. 9, 2007, under 35 U.S.C 119 and all the benefits accruing therefrom, the contents of which are incorporated by reference herein in their entirety.

TECHNICAL FIELD OF THE INVENTION

The present invention relates to a protective device intended to protect the hand and more particularly the palmar side of the hand.

BRIEF DESCRIPTION OF RELATED ART

Carrying out certain human activities whether they are professional activities—jobs involving the use of tools—or leisure activities—trailbiking, quadbiking, mountain biking, climbing or nautical activities (sailing)—subjects the hands to stress and leads, in many cases, to the appearance of phlyctenae or blebs on the palm. A phlyctena is a skin lesion caused by friction which is expressed by a bullous swelling of the epidermis filled with a clear liquid. When the swelling of the epidermis is detached, it leaves raw flesh which may be painful and lead to the activity in question being stopped.

The wearing of gloves does not generally or inadequately prevents the formation of phlyctenae on the palm.

It therefore appears that the problem of hand protection during activities which stress it has not been addressed satisfactorily.

BRIEF SUMMARY OF THE INVENTION

The invention improves hand protection for a person who carries out an activity during which the hand is highly stressed.

The invention further improves hand protection without however making the use of the protection more complex.

The subject of the invention is predominantly a protective device which can be placed over a hand, comprising a protective sheet having a general rectangular shape, which may be composed of an elastic or nonelastic material; cut into this protective sheet are four circular openings positioned in an aligned manner level with its transverse median axis which connects the middle of each of the lengths; the four circular openings separating the protective sheet into a first part known as the palmar part and a second part known as the dorsal part; said protective sheet is coated on one of its sides with a hypoallergenic adhesive; the protective device also comprises a peelable film whose longitudinal and transverse dimensions are equal to those of the protective sheet which is superposed on the side of the protective sheet coated with the hypoallergenic adhesive.

The invention thus provides a protective device whose palmar and dorsal parts are placed respectively over the palm and over the back of the hand of a user, after the latter has introduced his four fingers into the circular openings.

The device according to the invention is thus simple to use and provides an effective protection against the friction undergone by the hand.

Provision may be made for the protective sheet to comprise two concave notches made in the middle of each of the lengths of the protective sheet, the notches being aligned with the four circular openings. This arrangement facilitates the closing movement of the fist and means that the wearing of the protective device is very well tolerated.

In one possible embodiment of the invention, the protective sheet is extended at one of its ends by two tabs.

According to one possibility, these two tabs extend transversely, an extension of the protective film being superposed on each of them. The presence of these two tabs makes it possible to retain the device when it is in place on the user's hand. The two parts encircle the wrist of the user and provide additional retention.

According to another possibility, the palmar part has a semicircular cutout which delimits two tabs.

Furthermore, it is envisioned that the protective device incorporates a removable strip positioned between the two tabs in the semicircular cutout. The presence of this additional strip proves particularly useful for additionally protecting a phalanx of a finger.

Preferably, the protective device is symmetrical relative to its transverse median axis and relative to its longitudinal median axis, which means that the device may be placed on either a right hand or a left hand.

It may be envisioned that the first part known as the palmar part of the protective sheet has a cutout substantially parallel to the four openings, so as to improve the ergonomics of the protective device. The cutout is, in effect, opposite the palmar crease and prevents folds of the protective sheet from forming.

To increase the protection, the first part known as the palmar part may have an overthickness substantially parallel to the four openings. This overthickness may be a gel or a textile material.

BRIEF DESCRIPTION OF THE FIGURES

So that it is clearly understood, the invention is described with reference to the schematic drawing appended hereto that represents, by way of nonlimiting examples, several embodiments of the protective device according to this invention.

DETAILED DESCRIPTION OF THE INVENTION

Figure 1:
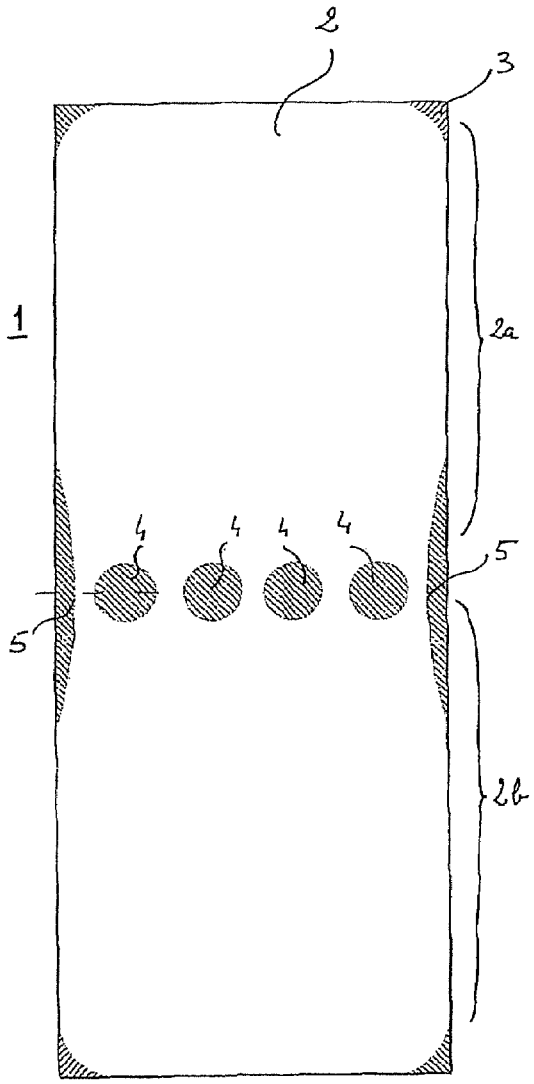
FIG. 1 is a top view of the protective device according to the invention in a first embodiment.

By referring first to FIG. 1, it appears that the protective device 1 has a general rectangular shape whose width may be, for example, around 100 millimeters and the length may be, for example, around 235 millimeters. These values are of course purely indicative and are given by way of example.

The protective device 1 is mainly composed of two components, namely a protective sheet 2 and a peelable film 3.

The protective sheet 2, of rectangular shape, is cut from a friction resistant elastic or nonelastic material. This material may be a woven or nonwoven textile or may itself be a complex of various natural or synthetic textiles and/or synthetic films. This protective sheet 2 is coated with a hypoallergenic adhesive which may come into contact with the epidermis of a user, while ensuring the adhesion of the protective sheet without an undesirable side effect.

Figure 2:
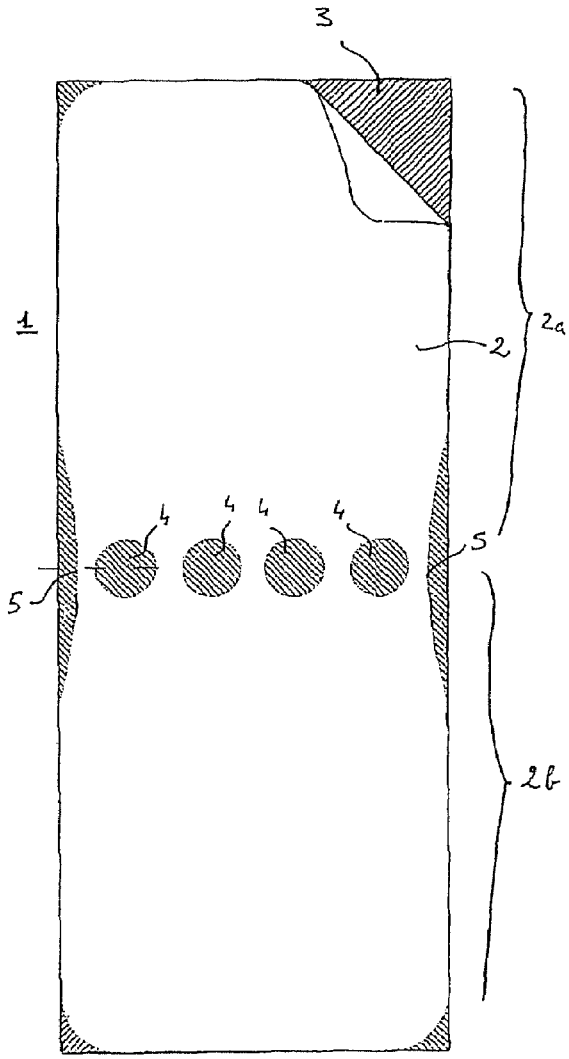
FIG. 2 shows the device from FIG. 1 prior to its use.

As can be seen in FIG. 1 and FIG. 2, provision is made for the protective sheet 2 to be provided with four circular openings 4. These circular openings 4 are aligned and are positioned on the transverse median axis of the protective sheet 2, that is to say the axis which connects the middle of each of the lengths of said sheet. These four circular openings 4 separate the protective sheet into two parts, namely a first part known as the palmar part 2*a* and a second part known as the dorsal part 2*b*.

It is also observed that, aligned with the four circular openings 4, the protective sheet 2 has two notches 5 which are themselves also positioned on the transverse median axis.

As can be seen in FIGS. 1 and 2, the protective sheet has two axes of symmetry, namely one axis of transverse median symmetry and one axis of longitudinal median symmetry.

It is also noted that each of the four corners of the protective sheet 2 have a rounded cutout.

The side of the protective sheet 2 which is coated with the adhesive sees, superposed to itself, the peelable film 3, whose coefficient of adhesion is low, so as to be able to be removed from the protective sheet 2.

Placement of the protective device over a user's hand is carried out in the following manner.

The user, firstly, detaches the peelable film from the first part of the protective sheet, namely the palmar part 2*a*; the operation for detaching the protective film is carried out carefully in front of the four circular openings 4 so that the user can engage his four fingers in the four circular openings 4.

Using his second hand, the user can flatten the palmar part 2*a* of the protective sheet 2 against the palm of his hand, so as to stabilize the protective sheet relative to the latter.

Secondly, the user detaches the whole of the peelable film 3 and then pulls down the dorsal part 2*b* of the protective sheet 2 over the back of his hand.

Figure 4:
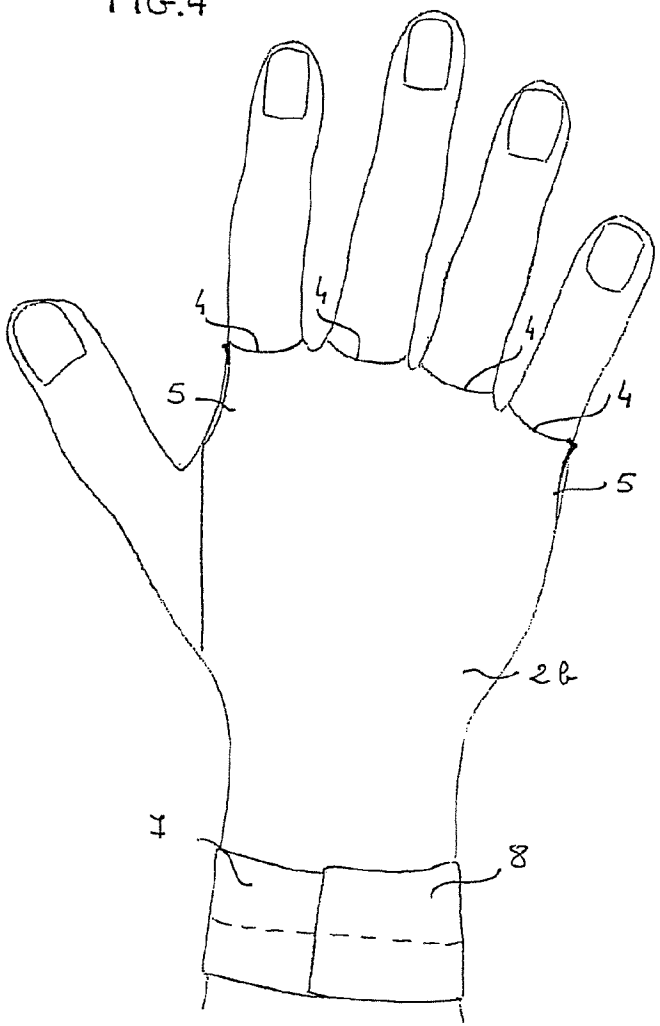
FIGS. 3 and 4 show a second embodiment of the device placed over a hand, respectively as a palmar view and as a dorsal view.
Figure 3:
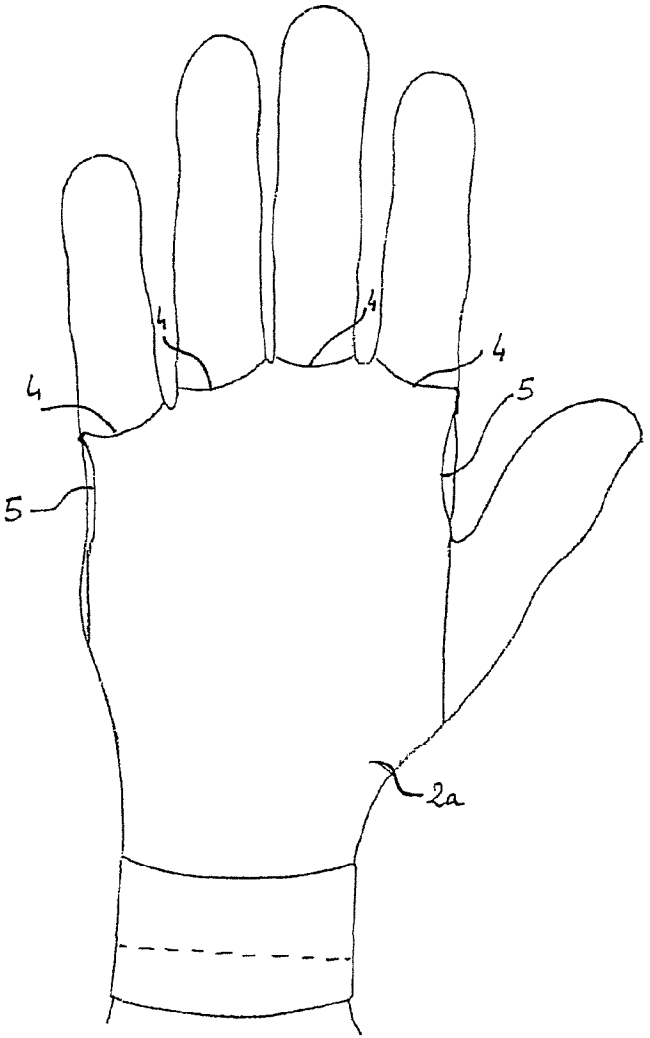

FIGS. 3 and 4 show the protective device in place on a user's hand.

FIG. 3 shows, in particular, the fact that the entire palm of the user's hand is protected.

FIGS. 3 and 4 show an embodiment variant of the protective device in which provision is made for the latter to be equipped at the end of its palmar part 2*a* with two tabs 7 and 8 which extend transversely relative to the protective sheet. These two tabs 7 and 8, which are also covered by a peelable film and which constitute extensions of the protective sheet 2, make it possible, after removal of the peelable film 3 which protects their adhesive side, to provide an extra hold of the device on the user's hand. FIG. 4, which illustrates the dorsal side of a user's hand equipped with the device, shows the two tabs 7 and 8 which overlap and which are superposed over the dorsal part 2*b* of the device.

It is specified that the device may be used in combination with protective gloves and that these two tabs 7 and 8 make it possible to provide an additional hold which prevents the protective device from being torn off the hand of the user when the latter removes his gloves.

Figure 5:
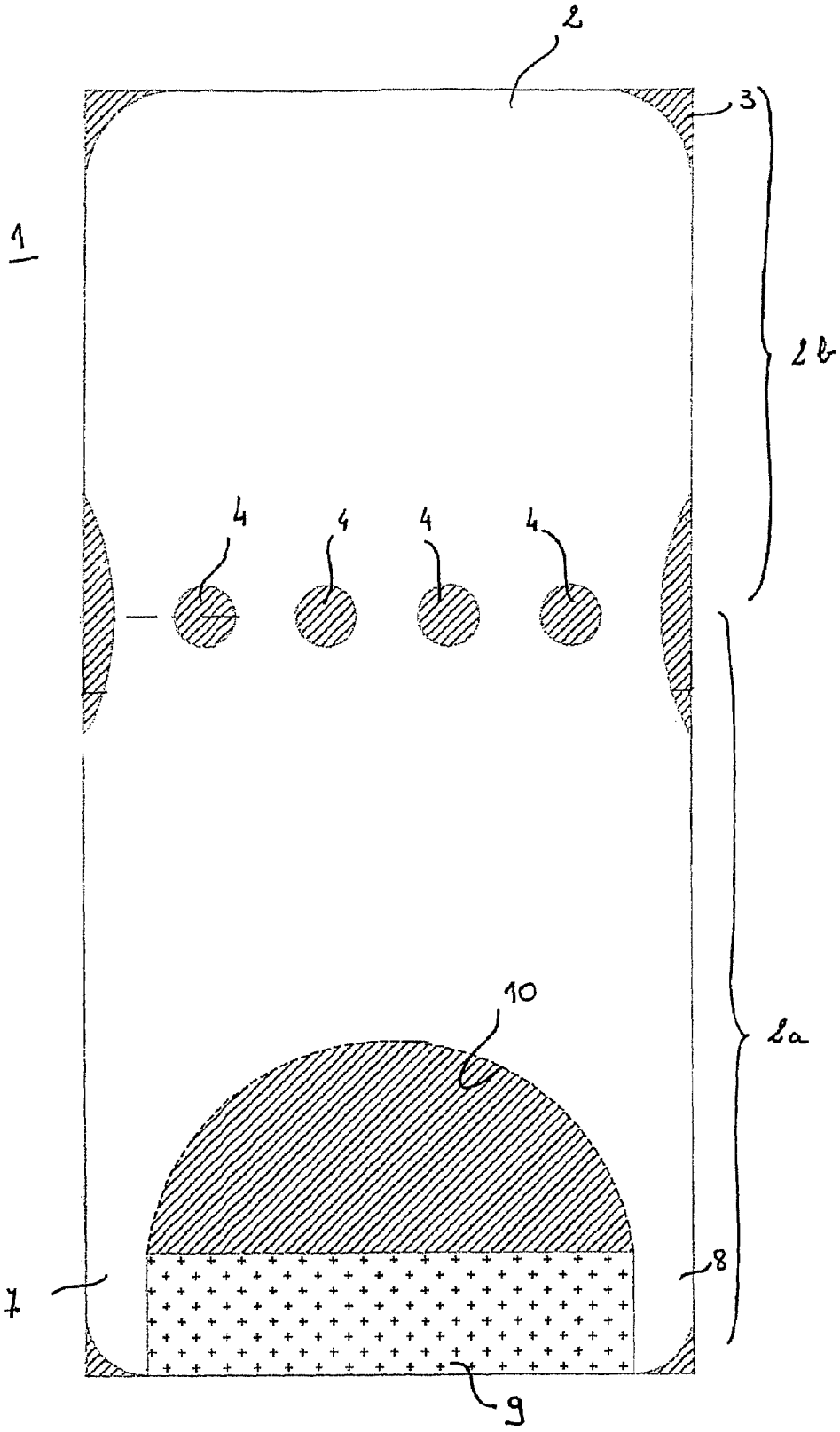
FIG. 5 is a top view of the device according to the invention in another embodiment.

FIG. 5 shows an embodiment of the device in which the palmar part 2*b* of the latter has a substantially semicircular cutout 10 which delimits two tabs 7 and 8. During the placement of the device on the user's hand, the two tabs are positioned around the user's wrist and are then covered by the dorsal part 2*a*.

The presence is also noted of a strip 9 of protective sheet which is positioned between the two tabs 7 and 8. The strip 9 may be used, for example, to cover the first phalanx of the thumb which may particularly be put under stress.

It may also be envisioned to ensure the holding of the protective device on the user's hand via a strip made from the same material as the protective sheet and protected by one and the same peelable film, which the user would add to his wrist by wrapping around it.

It can also be seen that the invention provides an ambidextrous protective device that is extremely easy to put on, which makes it possible to provide an extremely effective protection against the formation of phlyctenae during manual activity, whether it is a professional or leisure activity.

Of course, the invention is not limited to the two embodiments described above by way of nonlimiting examples, but it embraces, on the other hand, all the embodiments.

It may especially be envisioned to provide that the protective sheet be equipped with an overthickness that provides an additional protection for the user's palm. This overthickness could be in the form of a gel, for example, or in the form of textile components added to the protective sheet.

It may also be envisaged to provide a cutout in the palmar part of the protective sheet, so as to prevent the formation of folds level with the palmar crease of the hand.

The invention claimed is:

1. A protective device to be worn on a hand, comprising:

a protective sheet having a generally rectangular shape, cut into which are four circular openings adapted to receive fingers of the hand positioned in an aligned manner level with a transverse median axis of the protective sheet, the four openings separating the protective sheet into a first part known as a palmar part and a second part known as the dorsal part; said protective sheet being coated with a hypoallergenic adhesive; and a peelable film having longitudinal and transverse dimensions generally equal to those of the protective sheet superposed on the side of the protective sheet coated with the hypoallergenic adhesive;

wherein, when in use, the peelable film is removed from the protective sheet exposing the hypoallergenic adhesive, the fingers of the hand are inserted into the circular openings with the side of the protective sheet having the hypoallergenic adhesive being disposed proximate to the hand, the dorsal part of the sheet being folded onto a top of the hand, the palmar part being folded onto a palm area of the hand, the protective sheet being secured to the hand by the hypoallergenic adhesive.

2. The protective device as claimed in claim 1, wherein the protective sheet comprises two concave notches one on each side made in the middle of each of the lengths of the protective sheet, the notches being aligned with the four circular openings.

3. The protective device as claimed in claim 1, wherein the protective sheet is extended at one of its ends by two tabs.

4. The protective device as claimed in claim 3, wherein the two tabs extend transversely, on each of which an extension of the peelable film is superposed.

5. The protective device as claimed in claim 3, wherein the palmar part has a semicircular cutout which delimits two tabs.

6. The protective device as claimed in claim 5, wherein it has a removable protective strip positioned between the two tabs.

7. The protective device as claimed in claim 1, wherein it is symmetrical relative to its transverse median axis and relative to its longitudinal median axis.

8. The protective device as claimed in claim 1, wherein the palmar part of the protective sheet has a cutout substantially parallel to the four openings.

9. The protective device as claimed in claim 1, wherein the palmar part of the protective sheet has an overthickness substantially parallel to the four openings.

* * * * *